US007946200B2

(12) United States Patent
Chang

(10) Patent No.: US 7,946,200 B2
(45) Date of Patent: May 24, 2011

(54) ADJUSTABLE CLAMPING TOOL

(76) Inventor: Hsueh-E Hsu Chang, Taichung (TW)

( * ) Notice: Subject to any disclaimer, the term of this patent is extended or adjusted under 35 U.S.C. 154(b) by 237 days.

(21) Appl. No.: 12/479,804

(22) Filed: Jun. 6, 2009

(65) Prior Publication Data

US 2010/0000379 A1 Jan. 7, 2010

Related U.S. Application Data

(63) Continuation-in-part of application No. 12/165,655, filed on Jul. 1, 2008, now abandoned.

(51) Int. Cl.
*B25B 13/18* (2006.01)
*B25B 13/12* (2006.01)

(52) U.S. Cl. ..... 81/128; 81/129

(58) Field of Classification Search ..... 81/128, 81/129, 90.2, 90.3; 279/51, 58, 71, 122
See application file for complete search history.

(56) References Cited

U.S. PATENT DOCUMENTS

| | | | | |
|---|---|---|---|---|
| 915,443 | A * | 3/1909 | Jones | 81/62 |
| 1,482,075 | A * | 1/1924 | Fisher | 81/128 |
| 2,884,826 | A * | 5/1959 | Bruhn | 81/128 |
| 4,884,480 | A * | 12/1989 | Briese | 81/128 |
| 5,996,446 | A * | 12/1999 | Lee | 81/128 |
| 6,971,284 | B2 * | 12/2005 | Owoc | 81/58.2 |
| 2007/0000353 | A1 * | 1/2007 | Yu | 81/3.4 |

* cited by examiner

*Primary Examiner* — David B Thomas

(57) ABSTRACT

An adjustable clamping tool of the present invention includes a rotatable disc, two clamp portions, two slidable shanks, two rails and a housing member. When the rotatable disc is turned, the clamp portions are therefore driven to move toward or away from each other along the rails.

11 Claims, 5 Drawing Sheets

ADJUSTABLE CLAMPING TOOL

This application is a Continuation in Part (CIP) of previously U.S. application Ser. No. 12/165,655, and claims the priority of the filing date of Jul. 1, 2008 now abandoned, and claims 1 in the current CIP application correspond to claims 1-2 in the parent application, and are entitled to the parent application's filing date of Jul. 1, 2008.

BACKGROUND OF THE INVENTION

Description of the Prior Art

Conventional socket wrench set includes different sizes of sockets and a tool handle so as to be used in different conditions, accordingly the user has to replace sockets repeatedly, causing a tedious replacement and a portable inconvenience.

U.S. Pat. No. 2,778,260 has arisen to resolve these problems. The socket wrench it provides has adjustable jaws, and the jaws are movable by turning a gear set thereof. Nevertheless, there are gaps inevitably existing between two adjacent gear wheels, thus the size of the jaws can't be continuously increased or decreased to accurately engage a workpiece.

U.S. Pat. No. 4,884,480 provides an adjustable socket device, which has two jaw members with cam surfaces and a collar abutting the cam surfaces. The height of the collar is adjustable to move the two jaw members toward or away from each other. In this patent, a slide element is disposed on the bottom of each jaw member to be engaged with a keyway. However, the slide elements and the keyway will inevitably have gaps formed therebetween, causing the jaw members being too oscillatable to tightly engage a workpiece. Besides, the more distance the jaw members are away from each other, the less capability the socket device can bear the torsional force.

As taught in U.S. Pat. No. 4,898,052, a socket wrench is provided with two adjustable jaws, and threaded holes are formed on the jaws for a worm gear member to mount therethrough. Thus the jaws are adjusted to open or close by turning the worm gear member. However, the means to turn the worm gear member is complex, and the threaded holes as well as worm gear member should be accurately formed, or otherwise it would be uneasy to turn the worm gear member, causing more abrasion and oscillation to the jaws. Therefore, this kind of socket wrench must be precisely manufactured to mitigate these disadvantages, which leads to high manufacture cost.

Other patents, such as U.S. Pat. Nos. 2,745,305, 6,971,284, 6,073,522, 5,996,446, 5,448,931, 3,209,624, 2,884,826, 1,450,641, 915,443 and 679,929, have taught adjustable means to move the jaws by turning a rotatable disc.

Among the above-mentioned patents, U.S. Pat. No. 3,209,624 is about "Tools for removing and fitting back plates of watches". The bottom wall of the tool includes a spiral passage to slidably engage with upstanding posts. The similarities between this tool and that of the present invention end there. For obvious reasons a tool for removing and fitting back plates of watches is wholly unsuitable for engaging workpiece such as a screw.

In addition, U.S. Pat. Nos. 679,929, 915,443, 1,450,641, 2,745,305, 2,884,826, 5,448,931 and 6,073,522 have one thing in common is that they all include a rotatable disc with circular slot and jaws having a pin to insert into the circular slot, thus the jaws are driven to move as the rotatable disc turns. Also, the jaws have flanges, or using a part of the main body thereof, to engage with guiding grooves to generate a cam effect. Therefore, the jaws are driven to move linearly toward or away from each other.

U.S. Pat. Nos. 6,971,284 and 5,996,446 generate similar cam effect by using rails to engage with the slide grooves formed on the periphery of the jaws. Accordingly the jaws are also linearly movable.

Though circular slots and linear guiding grooves (or rails) are used in the above-mentioned tools to enable the jaws to move linearly, they are all complex and hard to assemble. Besides, the guiding grooves (or rails) are formed on both sides of each jaw, thus the jaws are still too oscillatable to tightly engage a workpiece.

Except for the disadvantages mentioned hereinabove, the rotatable disc is designed to be directly driven (or indirectly driven as taught in U.S. Pat. No. 2,884,826) by the users on the flank of the tool, thus causing a turning inconvenience for the users as the tool is worked in a jammed space. Furthermore, it is also a problem that the rotatable disc disposed on the flank of the tool is likely to be accidentally turned to change the size of jaws.

SUMMARY OF THE INVENTION

The object of the present invention is to provide a guiding means, which includes two slidable shanks and guide bores formed on a control section of a clamp portion. Each slidable shank is fixed (or integrally formed) onto the control section at one end and perpendicularly extending outward at the distal end, which is slidably inserted into the guide bore of the other clamp portion. That is, one end of the slidable shank is fixed and the other end thereof is slidable with respect to the other clamp portion, therefore reducing the capability of oscillation between the slidable shanks and the clamp portions, such that the clamp portions can tightly engage with a workpiece.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figures 1, 1A:
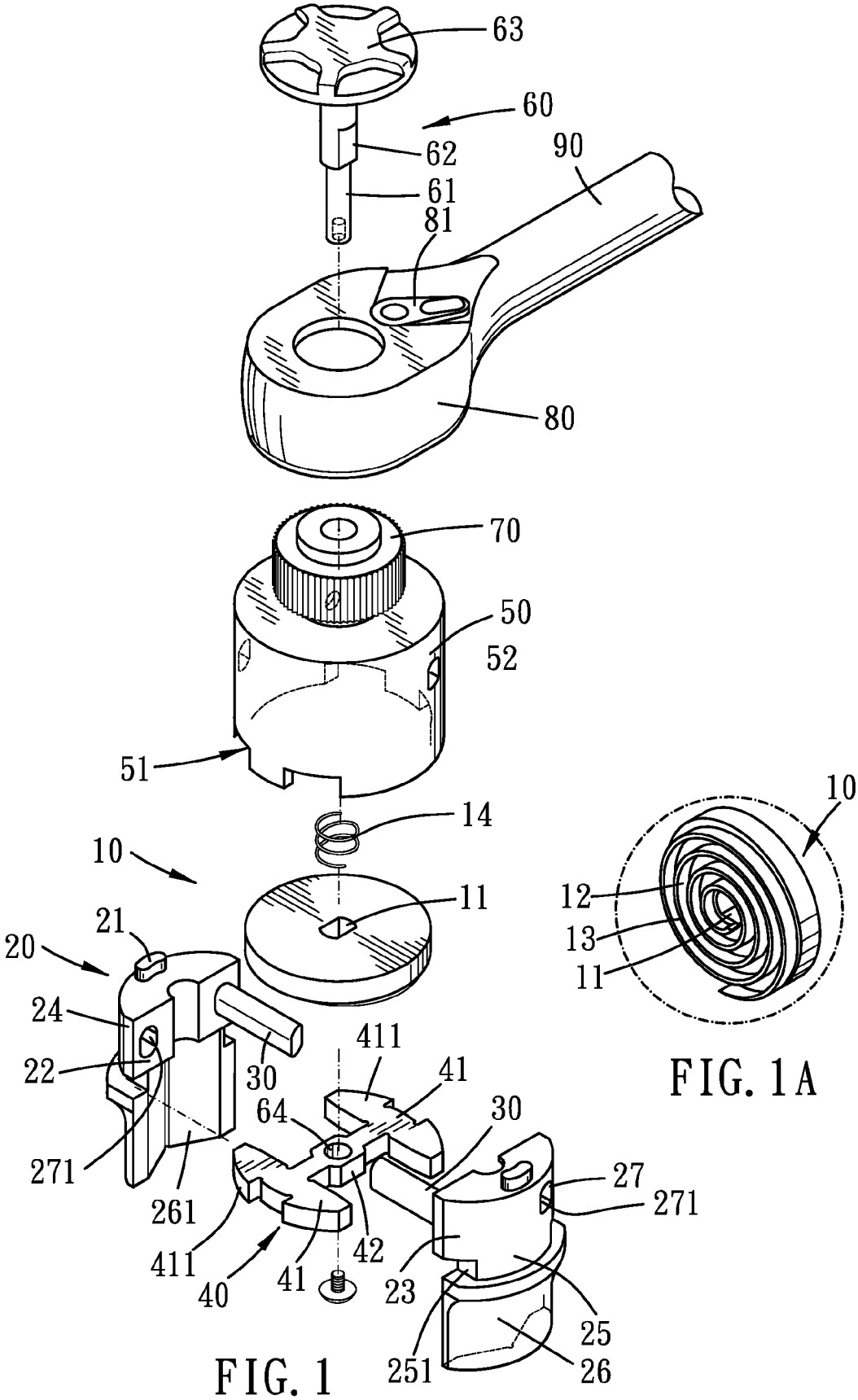
FIG. 1 is a breakdown drawing showing an adjustable clamping tool in accordance with a preferred embodiment of the present invention.
FIG. 1A is a schematic drawing showing a rotatable disc of the present invention at another angle of view.
Figure 2:
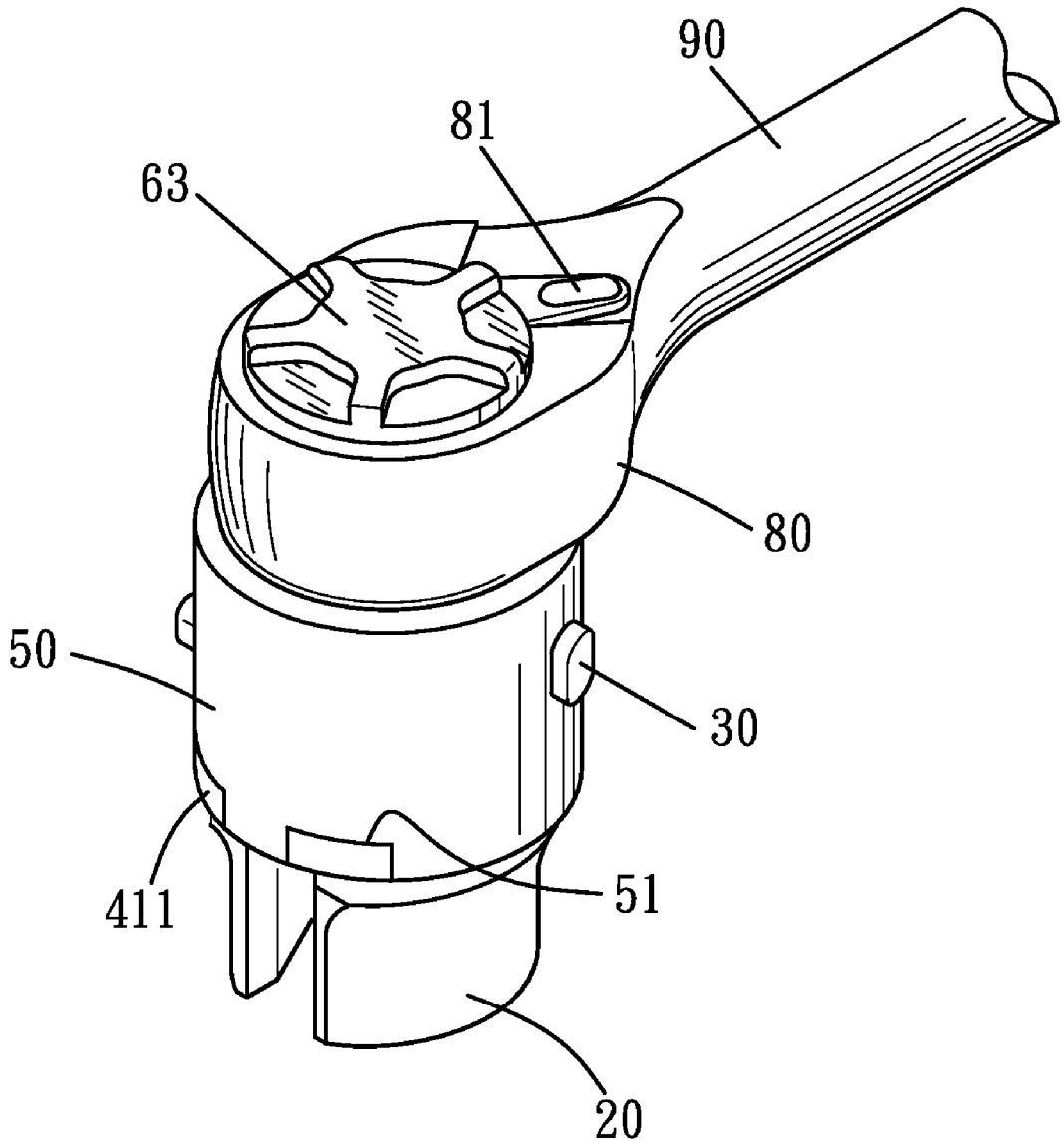
FIG. 2 is a combination drawing showing an adjustable clamping tool in accordance with a preferred embodiment of the present invention.
Figure 3:
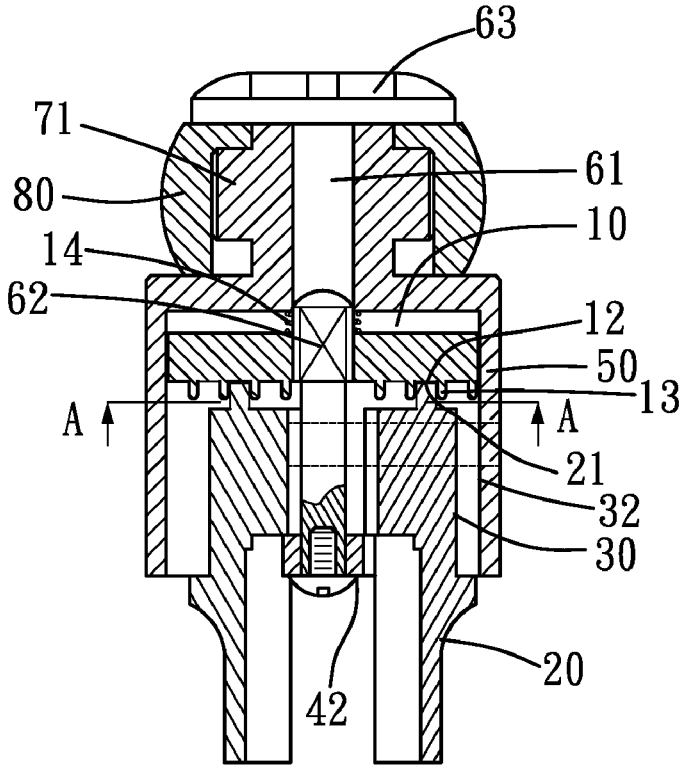
FIG. 3 is a profile showing an adjustable clamping tool in accordance with a preferred embodiment of the present invention.
Figure 4:
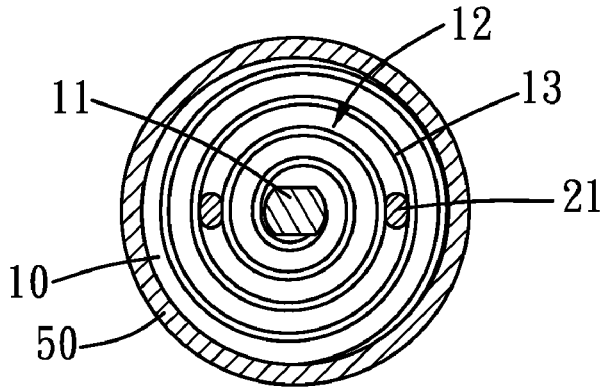
FIG. 4 is an AA profile of the adjustable clamping tool in FIG. 3.
Figure 5:
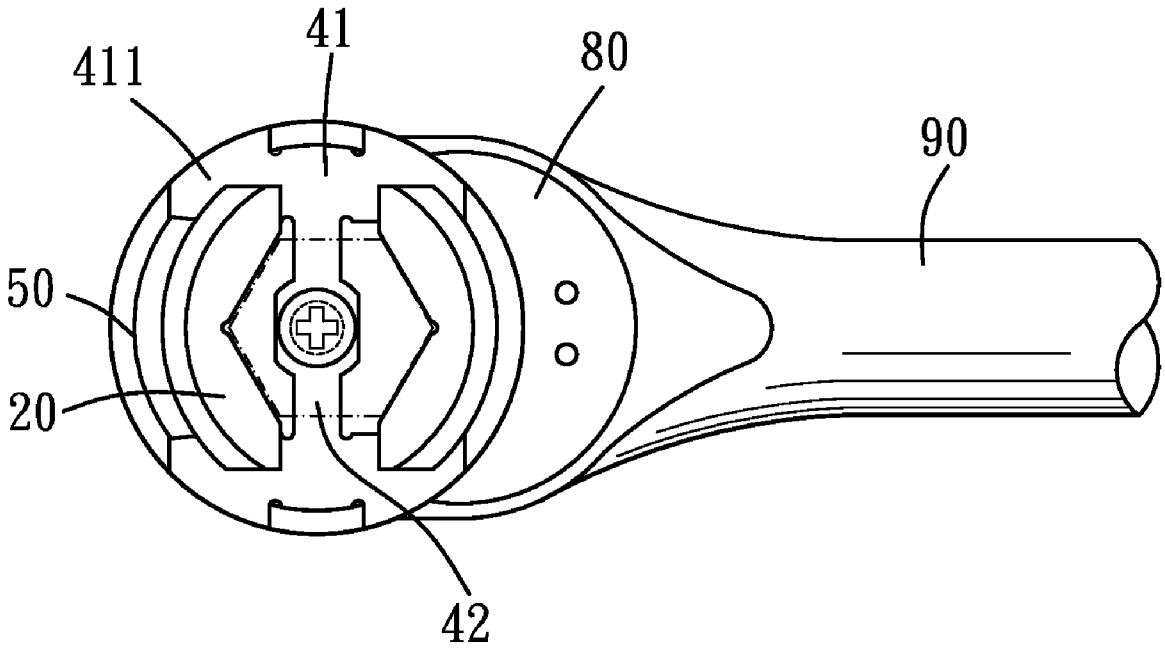
FIG. 5 is a bottom view showing an adjustable clamping tool in accordance with a preferred embodiment of the present invention.

FIG. 1 to FIG. 5 show an adjustable clamping tool of the present invention. The clamping tool includes a rotatable disc 10, two clamp portions 20, two longitudinal slidable shanks 30, a base 40, a housing member 50 and a control member 70.

The rotatable disc 10 is a circular plate with a non-circular hole 11 formed at the center thereof. The rotatable disc 10 includes a spiral passage 12 formed on a bottom surface thereof, and the spiral passage 12 surrounds the center of the rotatable disc 10 in a radius increasing manner. It is preferred that the angle the spiral passage surrounds the center is more than 360 degrees, i.e. more than one full round. In the present embodiment, the spiral passage 12 is defined between the circular rib 13 axially extending from the rotatable disc 10. The spiral passage 12 is solo and continuously disposed on the rotatable disc 10, yet it is possible to dispose more than one spiral passage 12, which depends on the amount of guide bosses 21 on the clamp portions 20 and how the spiral passages 12 and the guide bosses 21 coact. In addition, the circular rib 13 is integrally formed on the rotatable disc 10 in the manner of milling, die casting or the like. Or, the circular rib 13 can be disposed on the rotatable disc 10 by other means such as welding in condition of sufficient mechanical strength.

Each clamp portion 20 has an inner wall 22, an outer wall 23 and two side walls 24 connecting the inner and outer walls 22, 23, and the inner walls 22 of the clamp portions 20 face each other. In addition, each clamp portion 20 has a control section 27, a middle section 25 and a clamp section 26 integrally disposed from a top to a bottom of the clamp portion 20 in sequence. Each middle section 25 has two notches 251 disposed on its side walls 24, each clamp section 26 has a clamp surface 261 on its inner wall 22 to mount a workpiece, and each control section 27 has a guide bore 271 laterally penetrates the inner and outer walls 22, 23. The stretching orientation of the guide bores 271 and the notches 251 is parallel with each other. The control section 27 further has a guide boss 21 disposed on a top surface thereof, and the guide bosses 21 are slidably received in the spiral passage 12. It is to be understood that more than one guide boss 21 can be disposed on each control section 27 when necessary. In the present embodiment, the guide boss 21 and the control section 27 are integrally formed. However, it is still possible to form a bore on top of the control section 27 for the guide boss 21 to install therein. The profile of the guide boss 21 is arc shaped as can be seen in this embodiment, in which the guide boss 21 contacts the circular rib 13 in greater area, yet other shape such as a cylinder is also acceptable as long as the guide boss 21 is insertable into the spiral passage and enable the clamp portion 20 to be driven by the rotatable disc 10.

The slidable shanks 30 are disposed on the clamp portion 20 respectively. More specifically, one end of each slidable shank 30 is perpendicularly fixed on the inner wall 22 of one of the control sections 27. The slidable shank 30 and the guide bore 271, which are stationary disposed on the same control section 27, are disposed at the same height of the control section 27 and they are the same distance away from a vertical central line of the control section 27, in which the central line can divide the control section 27 into two equal parts, i.e. right and left parts. Each slidable shank 30 fixed on a clamp portion 20 at one end thereof is slidably received in the guide bore 271 of the other clamp portion 20.

The base 40 includes two rails 41 and a bridge section 42, and the bridge section 42 bridges the middle portion of the rails 41 such that the two rails 41 are parallel with each other. Two opposite ends of each rail 41 are engaged with the notches 251, which are disposed on the same side and belong to different clamp portions 20. An stretching orientation of the rails 41 is parallel with that of the guide bores 271.

The housing member 50 has a receiving bore to cover the rotatable disc 10, the slidable shanks 30, the rails 41 and a part of the clamp portions 20 such as the control sections 27. The two clamp portions 20 are linearly movable along the slidable shanks 30 and the rails 41, in which the rails 40 are stationary with respect to the housing member 50. Thus, it is preferred that a positioning means is disposed between the rails 40 and the housing member 50. The positioning means includes, for example, recesses 51 disposed at a bottom of the housing member 50 and flanges 411 extending outward from the peripheries of the rails 41 to mount in the recesses 51 for positioning purpose. In addition, two position holes 52 are disposed on the periphery of the housing member 50 for distal ends of the slidable shanks to insert therethrough respectively. The cross section of the slidable shank 30 is oval shaped in the present embodiment to have better force conducting capability, but it could also be other shape such as circular, rectangular, any geometric shape or irregular shape. That is, the distal ends of the slidable shanks 30 are slidably engaged with the position holes 52 to further fix the height of the slidable shanks 30 and the clamp portions 20. Furthermore, a resilient element 14, i.e. a spring or the like, is disposed between the housing member 50 and a top surface of the rotatable disc 10 to push the rotatable disc 10 toward the clamp portions 20, such that the guide bosses 21 on the clamp portions 20 can be readily inserted into the spiral passage 12 of the rotatable disc 10.

In the present embodiment, a control member 60 is used to drive the rotatable disc 10 to turn. The control member 60 has a spindle 61 extending outward, and the spindle 61 has a non-circular section 62 formed on a relatively middle part thereof. The non-circular section 62 is engaged with the non-circular hole 11 of the rotatable disc 10. Moreover, the control member 60 further has a grip portion 63 disposed on the top thereof for the users to turn the control member 60, as well as the rotatable disc 10 due to the engagement between the non-circular section 62 and the hole 11. Instead of driving the rotatable disc 10 on the flank of the clamping tool by applying force on the periphery of the disc 10 as conventional art does, the present invention provides another way to drive the rotatable disc 10 by the control member 60, which applies force on the center of the rotatable disc 10. An obvious advantage is that the rotatable disc 10 is turned on the top of the clamping tool rather than on the flank thereof, which leads to less operation space required. Also, the control member 60 is less likely to be accidentally turned, and the housing member 50 is therefore possible to fully cover the rotatable disc 10 therein to prevent foreign object or dust from entering the spiral passage 12. What's more, the spindle 61 further passes through the through hole 64 disposed at a center of the bridge section 42, and thereafter the distal end of the spindle 61 is fastened to the bridge section 42 by a screw or a C-shaped retainer. In other words, the control element 60 not only functions as a driving mechanism to turn the rotatable disc 10, but also as a retaining mechanism to assemble the clamping tool.

To adjust the spacing interval between the clamping portions 20, the users can turn the control element 60 so as to further turn the rotatable disc 10, thus the clamp portions 20 are driven, due to the engagement between the guide bosses 21 and the spiral passage 12, to move toward or away from each other along the stretching orientation of both the guide bores 271 (and the corresponding slidable shanks 30) and the notches 251 (and the corresponding rails 41). Both the slidable shanks 30 and the rails 40 are used as cam rails to guide the clamp portions 20 to move linearly, which means each clamp portion 20 is retained at four points, i.e. two shanks 30 and two rails 40, realizing the two-dimensional retaining effect due to the position differences in both vertical and horizontal directions between the slidable shanks and the rails. Furthermore, the present invention also provides a guiding means including two slidable shanks 30 and guide bores 271. Each slidable shank 30 is fixed (or integrally formed) onto the control section 27 at one end and perpendicularly extending outward at the distal end, which is slidably inserted into the guide bore 271 of the other clamp portion 20. That is, one end of the slidable shank 30 is a stationary end and the other is a slidable end. Therefore, the capability of oscillation between the slidable shanks and the clamp portions is significantly reduced, such that the clamp portions 20 can tightly engage with a workpiece and can linearly move along the slidable shanks 30 smoothly. No matter how the spacing interval between the clamp portions 20 varies, the capability to bear the torsional force of the clamp portions 20 stays unaltered. Moreover, each clamp portion 20 has a slidable shank 30 fixed thereon, accordingly it is more convenient to assemble two clamp portions by simply inserting distal ends of the slidable shanks 30 into the guide bores 271. It would be readily understood that the adjustable clamping tool of the present invention has enhanced assemblability, thus leading to significantly manufacture time and cost reduce.

In order to drive a workpiece, the clamping tool of the present invention is further provided with a ratchet mechanism 70, a driving head 80 and a handle 90. The ratchet mechanism 70 is installed on the housing member 50 in a linking-up relationship, the handle 90 laterally extends from the driving head 80, and the ratchet mechanism 70 is drivable by the driving head 80. Both the ratchet mechanism 70 and the driving head 80 have holes for the spindle 61 to insert therethrough. To state it more specifically, the driving head 80 has a tooth portion to engage with the ratchet mechanism 70 in solo-directional or two-directional driving engagement. The driving head 80 may further has a switch 81 to alter the direction of the driving engagement. Accordingly, the users can apply force on the handle 90 to rotate the ratchet mechanism 70, the housing member 50 and, the most importantly, the clamp portions 20, so as to drive the workpiece.

There is still another way to drive the workpiece. The housing member 50 may include at least two driving surfaces disposed on the periphery thereof for a wrench to engage therewith. Or, of course, the housing member 50 can be polygonal in shape for the wrench to easily engage therewith.

Figure 6:
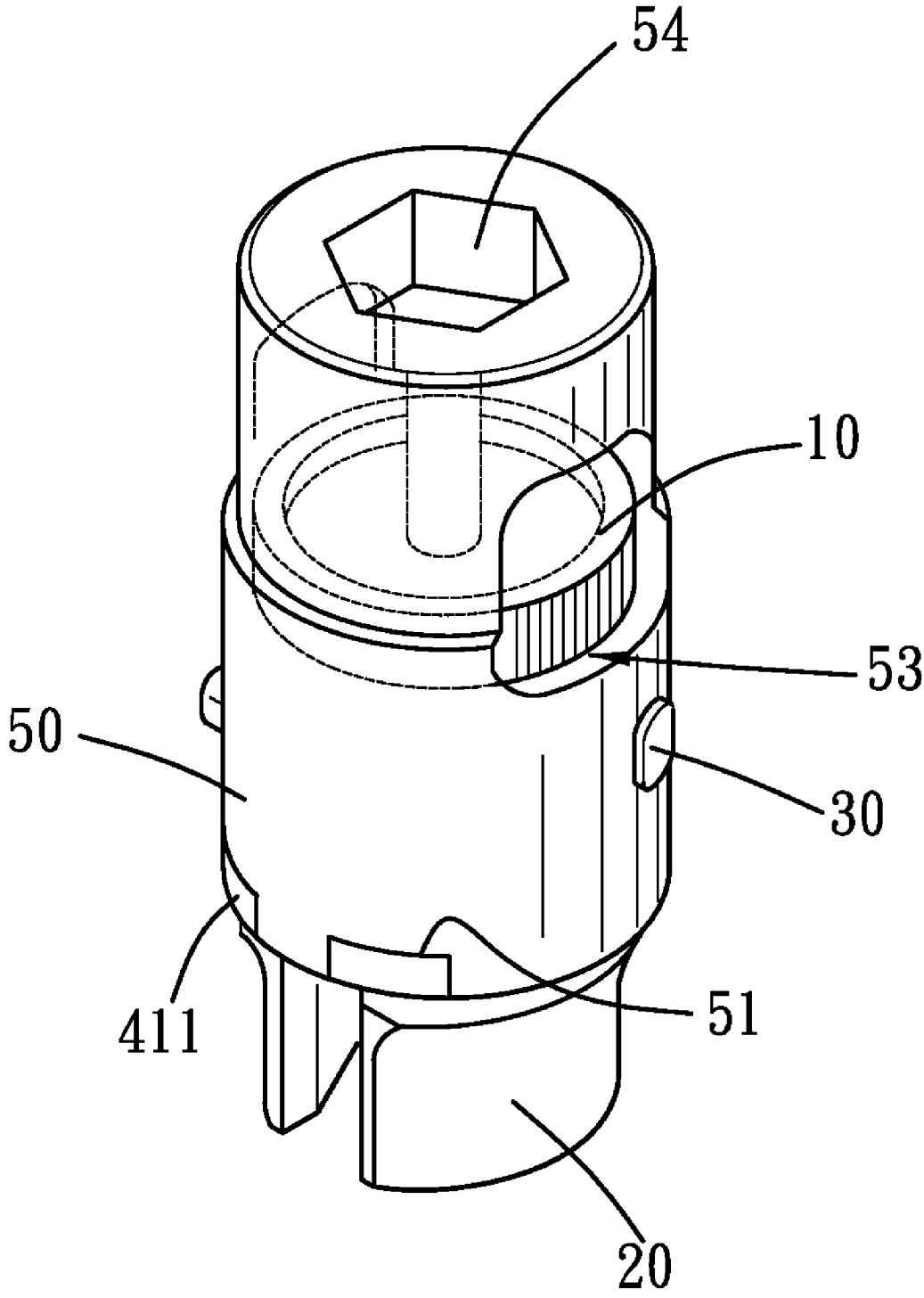
FIG. 6 is a schematic drawing showing an adjustable clamping tool in accordance with another preferred embodiment of the present invention.

FIG. 6 is another embodiment of the present invention. The clamping tool of the present embodiment further includes at least one opening 53 on the periphery of the housing member 50. The openings 53 correspond to the rotatable disc 10 for the users to directly turn the rotatable disc 10 therethrough. Also, the clamping tool of the present embodiment can be used as an adapter, and a driving portion 54, which is a hexagonal (or other polygonal) hole, can be disposed atop the housing member 50 for a L-shaped tool or T-shaped tool with a hexagonal bar to engage therewith.

What is claimed is:

1. An adjustable clamping tool comprising a rotatable disc, a spiral passage being disposed on a surface of the rotatable disc, and the spiral passage surrounding a center of the rotatable disc in a radius increasing manner;

two clamp portions, each having an inner wall, an outer wall and two side walls connecting the inner and outer walls, the inner walls of the clamp portions facing each other; from a top to a bottom of each clamp portion being integrally disposed a control section, a middle section and a clamp section in sequence; each clamp section having a clamp surface on its inner wall; each control section having a guide bore, which laterally penetrates between the inner and outer walls, and at least a guide boss disposed on a top surface of the control section; the guide bosses being slidably received in the spiral passage;

two longitudinal slidable shanks disposed on the clamp portions respectively, one end of each slidable shank being perpendicularly fixed on the inner wall of one of the control sections; the slidable shank and the guide bore, which are disposed on the same control section, being disposed at the same height of the control section and they are the same distance away from a central line of the control section; each slidable shank on a clamp portion being slidably received in the guide bore of the other clamp portion; and a housing member, having a receiving bore to cover the rotatable disc and the slidable shanks, on a periphery of the housing member being disposed two position holes for distal ends of the slidable shanks to insert therethrough respectively;

wherein, when the rotatable disc is turned, the clamp portions are driven to move toward or away from each other along an stretching orientation of the guide bores.

2. The adjustable clamping tool of claim 1, further comprising two rails received in the housing member, each middle section having two notches disposed on both of its side walls, two ends of each rail being engaged with the notches, which are disposed on the same side and belong to different clamp portions; an stretching orientation of notch being parallel with that of the guide bores.

3. The adjustable clamping tool of claim 2, further comprising a bridge section disposed between middles of the rails.

4. The adjustable clamping tool of claim 3, further comprising a control member having a spindle extending outwardly, a non-circular section being disposed on the spindle, and a non-circular hole being disposed at the center of the rotatable disc for the non-circular section to engage therewith.

5. The adjustable clamping tool of claim 4, wherein the bridge section has a through hole at a center thereof for the spindle to insert therethrough.

6. The adjustable clamping tool of claim 1, further comprising a control member having a spindle extending outwardly, a non-circular section being disposed on the spindle, and a non-circular hole being disposed at the center of the rotatable disc for the non-circular section to engage therewith.

7. The adjustable clamping tool of claim 1, wherein each rail includes at least one flange extending outwardly from a periphery of each rail, and the housing member includes recesses disposed at a bottom thereof for the flanges to mount therein.

8. The adjustable clamping tool of claim 1, wherein the housing member includes at least one opening, which corresponds to the rotatable disc, disposed on the periphery thereof for the user to directly turn the rotatable disc.

9. The adjustable clamping tool of claim 1, wherein a resilient element is disposed between the housing member and a top surface of the rotatable disc to push the rotatable disc toward the clamp portions.

10. The adjustable clamping tool of claim 1, wherein the housing member includes at least two driving surfaces disposed on the periphery thereof for a wrench to engage therewith.

11. The adjustable clamping tool of claim 1, further comprising a ratchet mechanism, a driving head and a handle laterally extending from the driving head, the ratchet mechanism being disposed on the housing member in a linking-up relationship, and the ratchet mechanism being drivable by the driving head.

* * * * *